US005311996A

United States Patent [19]

Duffy et al.

[11] Patent Number: 5,311,996

[45] Date of Patent: May 17, 1994

[54] EDGE PROTECTOR

[76] Inventors: Thomas J. Duffy, c/o Badger Plug Company, 1850 W. Reeve St., Appleton, Wis. 54912; Roger R. Hauger, Jr., 900 Highridge Ct., Miamisburg, Ohio 45342

[21] Appl. No.: 658

[22] Filed: Jan. 5, 1993

[51] Int. Cl.[5] ..... B65D 6/36; B65D 63/00

[52] U.S. Cl. ..... 206/453; 217/69; 24/16 R; 206/586

[58] Field of Search ..... 206/453, 586; 217/69-71, 66; 24/16 R

[56] References Cited

U.S. PATENT DOCUMENTS

| | | | |
|---|---|---|---|
| 3,073,439 | 1/1963 | Symmonds, Jr. | 206/453 |
| 3,152,693 | 10/1964 | Anderson | 206/453 |
| 3,199,709 | 8/1965 | Morrison et al. | 206/453 |
| 3,908,850 | 9/1975 | Jureit et al. | 206/453 |
| 3,960,091 | 6/1976 | Ehlert | 105/475 |
| 4,011,632 | 3/1977 | MacDonald | 24/16 R |
| 4,765,479 | 8/1988 | Roberts | 206/453 |
| 4,938,357 | 7/1990 | Schmidt | 206/453 |
| 5,056,664 | 10/1991 | Demers | 206/453 |

FOREIGN PATENT DOCUMENTS

| | | | |
|---|---|---|---|
| 268592 | 4/1966 | Australia | 217/69 |

*Primary Examiner*—William I. Price

[57] ABSTRACT

An edge protector for protecting goods having at least one edge against damage of the edge by a strap wrapping the goods comprises a force-distributing member for distributing a force applied by a wrapping strap to goods wrapped by the strap in such a manner as to protect the edge from damage by the strap. A spring clip connected to the force-distributing member and engageable with the strap secures the edge protector to the strap. The clip comprises a proximal portion attached to the force-distributing member and a distal portion spaced apart from the proximal portion and adjacent to but detached from the distal portion. The clip is formed with a cam that is contoured so that the strap can be pressed against the cam to elevate the distal portion of the clip relative to the force-distributing member and slid between the clip and the force-distributing member, thereby securing the strap and the edge protector together and militating against their inadvertent separation even upon removal of the strap from the goods.

12 Claims, 1 Drawing Sheet

EDGE PROTECTOR

BACKGROUND OF THE INVENTION

1. Field of the Invention

This invention relates to edge protectors for protecting goods having at least one edge against damage of the edge by a strap wrapping the goods and more particularly to a novel and highly effective edge protector constructed to prevent its inadvertent detachment from the wrapping strap even upon removal of the strap from the goods.

2. Description of the Prior Art

When certain goods are packaged for handling in a warehouse or for shipment they are often banded with a steel or plastic strap or tether. The goods may be stacked on a wooden, metal or plastic pallet, and several straps are passed through or around the pallet and around the goods to secure the goods so that they can be handled safely by a forklift or crane and thereby moved around a warehouse, loaded into a standard 20 foot or 40 foot container, or lowered into the hold of a ship.

Roll goods such as paper or sheet steel are often secured by wrapping straps extending longitudinally through the center and along the outside of the roll and radially along opposite ends of the roll.

In order to ensure that the goods are held securely, the bands are tightened with a considerable force, usually generated by a banding machine or similar equipment. The force supplied by a banding strap to the goods is highly concentrated where the strap bears against an edge of the banded goods, and to prevent damage to the edge of the goods, an edge protector is employed. Edge protectors are placed between the straps and the edges of the goods, and the straps bear on the edge protectors instead of directly on the banded goods.

An edge protector includes a plate or similar structure to distribute over a relatively large area the force that would otherwise be applied directly to a small part of an edge.

Conventional edge protectors, however, have some inconvenient aspects. One is that they are awkward to put into service.

Certain edge protectors are for example put into service by threading an end of a banding strap through a first aperture in the edge protector from the bottom side to the top side of the edge protector, passing it over the top of the edge protector, and threading it through a second aperture from the top side to the bottom side. The part of the edge protector between the two apertures is placed over an edge to be protected. In many facilities, hundreds of edge protectors are used per day, and the aggregate time devoted to the threading operation is considerable and adds commensurately to the cost of handling the goods.

Another type of conventional edge protector is provided with tabs that can be raised by hand to accept a banding strap and then lowered on the strap to connect the edge protector and the strap together. This has the advantage that the strap can be connected to the edge protector by a relative lateral movement; in other words, it is not necessary to thread the end of the strap through an aperture. However, it is awkward to raise the tabs by hand while engaging the straps; typically one or more digits of one hand must push down on a first part of the edge protector and one or more digits of the same hand must pull up on another part of the edge protector while the other hand inserts the strap. This requires enough manual dexterity that some people find it objectionable and accomplish it only with difficulty. Even those who are quite dextrous find that a certain amount of time and patience is required to accomplish the task. If the task must be repeated hundreds of time in an eighthour work shift, there is some risk of developing tunnel carpel syndrome or other injury due to repetitive motion.

U.S. Pat. No. 3,073,439 discloses an edge protector having an opening 30 so that masking tape 32 (FIG. 2) can be employed to prevent the edge protector from moving relative to the protected goods. In the modification of FIG. 5, an adhesive patch 134 is employed.

U.S. Pat. No. 3,152,693 discloses an edge protector having tabs 15 that can be manually pivoted about flexible hinges 16 to accept a strap 13. When the strap 13 is inserted, the tabs 15 prevent it from becoming dislodged.

U.S. Pat. No. 3,908,850 discloses a protector having shoulders 32 that position it with respect to a strap 20 and teeth 38 for securing it to a wooden crate or the like.

U.S. Pat. No. 3,960,091 discloses a rope hook mount having a lip 17 formed with a free end 20 extending over a central aperture 16 so that a rope 19 can be anchored under the lip 17 and used to stabilize cargo in a vehicle such as a truck or boat.

U.S Pat. No. 4,011,632 discloses a protector having a lip 28 that can be slipped between adjacent cartons 14 in a stack of cartons.

U S. Pat. No. 4,938,357 discloses an edge protector formed with a slot 9 for a strap 2 and with a tab 12 that extends over the strap 2. However, the tab 12 is not formed with a cam at its distal end. Moreover, the strap 2 does not overlie any part of the arm 6 between the slot 9 and the edge 10. While this device may stay attached to the strap 2 after the strap 2 is cut, the method of attachment is relatively cumbersome and requires that the tab 12 be bent out manually to receive the strap 2 or that the strap 2 be threaded through the slot 9 from the bottom.

U.S. Pat. No. 5,056,664 discloses an edge protector formed with openings 14 and 15 so that a tether 17 can be passed through the openings to secure the protector to a stack 16. While the strip 11 will not separate from the tether 17 when the tether 17 is cut, the tether 17 can be secured to the strip 11 only by threading it through the openings 14 and 15, which is a relatively cumbersome procedure.

OBJECTS AND SUMMARY OF THE INVENTION

An object of the invention is to remedy the problems of the prior art outlined above. In particular, an object of the invention is to provide an edge protector that is convenient to use and that does not inadvertently become separated from a wrapping strap even when the wrapping strap is cut in order to remove it from the wrapped goods.

The foregoing and other objects are attained in accordance with the invention by providing an edge protector for protecting goods having at least one edge against damage of the edge by a strap wrapping the goods. The edge protector comprises a force-distributing member for distributing a force supplied by a wrapping strap to the goods wrapped by the strap in such a manner as to protect the edge from damage by the strap. A spring clip is connected to the force-distributing member and engageable with the strap for securing the edge protector to the strap. The clip comprises a proximal portion attached to the force-distributing member and a distal portion spaced apart from the proximal portion and adjacent to but detached from the force-distributing member. The distal portion is formed with a cam that is contoured so that the strap can be pressed against the cam to elevate the distal portion of the clip relative to the force-distributing member and slid between the clip and the force-distributing member, the force-distributing member then extending underneath the strap and the clip overlying the strap. This secures the strap and the edge protector together and militates against inadvertent separation of the strap and the clip even upon removal of the strap from the goods.

BRIEF DESCRIPTION OF THE DRAWING

Other objects, features and advantages of the invention can be gained from a consideration of the following detailed description of the preferred embodiment thereof in conjunction with the appended figures of the drawing, wherein.

DESCRIPTION OF THE PREFERRED EMBODIMENTS

FIGS. 1–4 show a preferred embodiment of an edge protector 10 constructed in accordance with the invention for protecting goods having at least one edge against the damage of the edge by a strap wrapping the goods. The goods are exemplified in FIGS. 2 and 3 as roll goods such as a roll of sheet steel, but there is no limit to the type of goods that can be wrapped by a wrapping strap and that require the protection of an edge protector.

Figure 2:
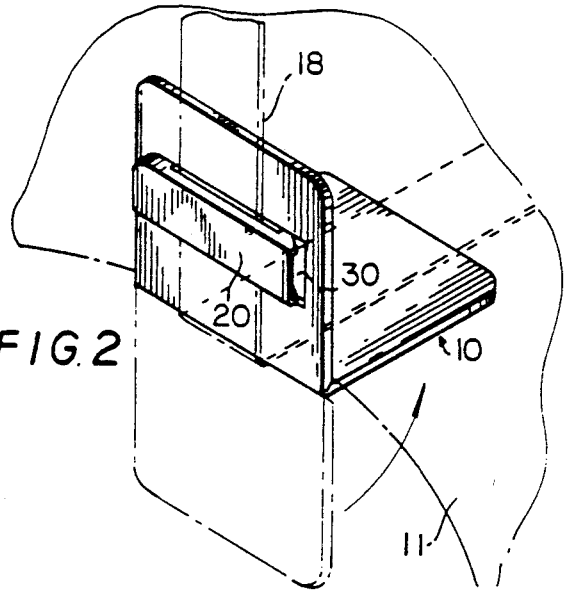
FIG. 2 is a perspective view showing the edge protector in place to protect an edge of roll goods wrapped by a strap.
Figure 3:
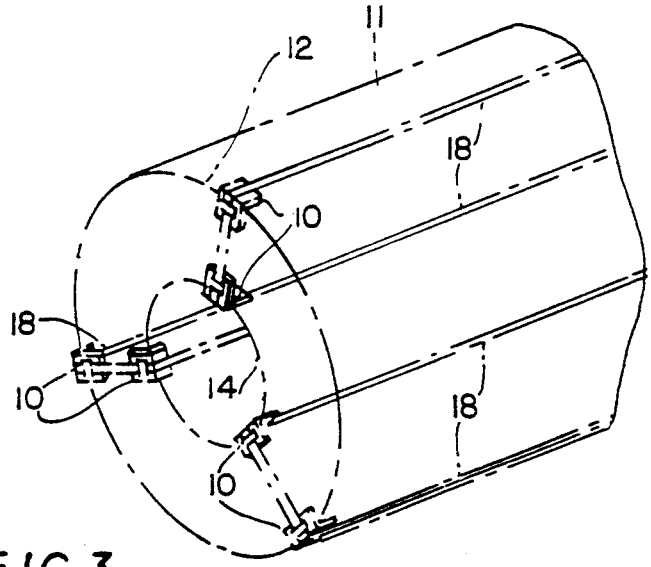
FIG. 3 is a perspective view on a smaller scale showing six edge protectors positioned at one end of roll goods to protect inner and outer edges of the roll goods.

In FIGS. 2 and 3, the roll goods 11 have an outer edge 12 and an inner edge 14 at each end of the cylinder formed by the roll goods. Both the outer edge and the inner edge must be protected at each end of the roll goods. Typically, three sets of edge protectors 10 will be employed at each end of the roll goods, the edge protectors of each set being spaced apart from one another by an average of 120°. Thus in the arrangement of FIG. 3, six edge protectors are employed at one end of the roll goods 11, and six more edge protectors are employed at the opposite end (not illustrated).

Of course, the number of edge protectors employed to protect the edges of designated goods will depend on the nature of the goods, the number and placement of straps employed, the strap width and strap tension, the number and fragility of the edges crossed by the straps, etc., as those skilled in the art will readily understand. The number and arrangement of edge protectors in FIGS. 2 and 3 are merely illustrative.

In accordance with the invention, the edge protector comprises a force-distributing member 16 for distributing a force applied by a wrapping strap 18 (of which three are illustrated in FIG. 3) to the goods 11 wrapped by the strap or straps 18 in such a manner as to protect the edges 12 and 14 from damage by the straps 18.

A spring clip 20 is connected to the force-distributing member 16 and engageable with the strap 18 for securing the edge protector 10 to the strap 18.

The clip 20 comprises a proximal portion 22 attached to the force-distributing member 16 and a distal portion 24 spaced apart from the proximal portion 22 and adjacent to but detached from the force-distributing member. The spring clip is normally in the position shown in solid outline in FIG. 1 but can be bent out to the position illustrated in broken outline.

Figure 1:
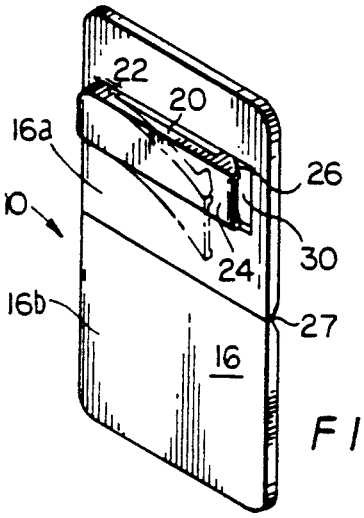
FIG. 1 is a perspective view of an edge protector constructed in accordance with the invention before its application to an edge of goods to be wrapped by a strap.
Figure 4:
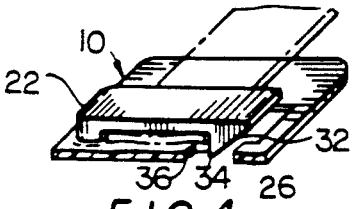
FIG. 4 is a fragmentary perspective view showing in more detail a construction of a portion of an edge protector in its preferred embodiment.

The distal portion 24 is formed with a cam 26 that is contoured as FIGS. 1 and 4 best show so that the strap 18 can be pressed against the cam 26 to elevate the distal portion 24 of the clip 20 relative to the force-distributing member 16 and slid between the clip 10 and the force-distributing member 16, the force-distributing member 16 then extending underneath the strap 18 and the clip 20 overlying the strap 18. The strap 18 and the edge protector 10 are thus secured together, and inadvertent separation of the strap 18 from the edge protector 10 is prevented even upon removal (as by cutting) of the strap 18 from the goods.

The force-distributing member 16 can be made of any suitable protective material including plastic and metal. Preferably, the force-distributing member 16 and the clip 20 are made of the same material. If the material is plastic, the edge protector 10 can easily be made in an injection-molding process.

The force-distributing member 16 is preferably made substantially in the shape of a rectangle, as indicated in FIG. 1. It is formed with a score line 26 facilitating its bending to form substantially a right dihedral angle, as best indicated in FIG. 2, or any other suitable angle, whereby the edge protector 10 can be applied to the goods with the score line substantially overlying the edge (12 or 14 for example) and in parallel relation thereto.

The score line 26 substantially bisects the rectangle, thereby dividing the edge protector into two legs **16*a* and 16*b* of substantially equal size. The clip 20 is preferably formed in a central portion of one of the legs, such as the leg 16*a***.

The force-distributing member 16 is formed with a through-slot 30 in the preferred embodiment of the invention, and the clip 20 is substantially coextensive with the through-slot.

The cam 26 includes an active portion 32 that slopes toward the proximal portion 22 and the force distributing member 16, and the active portion 32 includes an extension 34 that normally penetrates into the through-slot 30.

The extension 34 intersects a rear surface 36 that is contoured so that the strap 18 if pressed against the rear surface 36 will not elevate the distal portion 24 of the clip, whereby the cam can be operated only in a latching direction. That is, if the strap 18 is pushed against the surface 32, the clip will be forced away form the force-distributing member 16 so that the strap 18 can be slid underneath the clip 20. Once the strap 18 is slid underneath the clip 20, the clip 20 snaps to the position shown in FIG. 4. The rear surface 36 is a vertical surface, so that, if the strap 18 is pushed against the surface 36, it does not elevate the clip 20. As a result, the strap 18 is securely held by the clip; and conversely, the clip is securely attached to the strap when the strap is cut to unpackage the goods.

Figure 5:
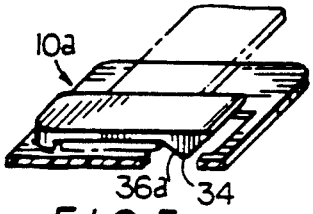
FIG. 5 is a fragmentary perspective view showing another embodiment of the invention.

FIG. 5 shows an alternative embodiment of the invention wherein the extension 34 intersects a rear surface **36*a* that is contoured so that the strap 18 if pressed against the rear surface 36*a* will elevate the distal portion 24 of the clip, whereby the cam can be operated in either a latching direction or an unlatching direction. This facilitates removal of the edge protector from the strap so that the edge protector can be reused. Of course, the embodiment of the edge protector shown in FIGS. 1–4** can also be reused, although it is harder to remove from the strap.

Figure 6:
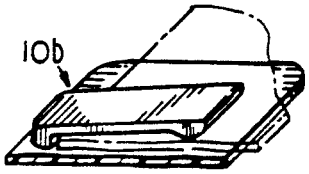
FIG. 6 is a fragmentary perspective view showing a third embodiment of the invention.

FIG. 6 shows another embodiment of the invention wherein the through-slot 30 is omitted. In this embodiment, the clip 20 simply pinches the strap 18 against the force-distributing member 16. Depending on the strength of the clip, this may be adequate. However, the more secure locking arrangement of FIG. 5 and, particularly, the very secure locking arrangement of FIG. 4 is preferred in accordance with the invention.

Thus there is provided in accordance with the invention a novel and highly effective edge protector for protecting goods against damage by a strap wrapping the goods. Edge protectors constructed in accordance with invention accomplish the objects of the invention, are easy to apply, and do not readily become separated from the strap when the strap is cut to unpackage the strapped goods.

Many modifications of the preferred embodiments disclosed above will readily occur to those skilled in the art. The invention is accordingly to be construed as including all structure that falls within the scope of the appended claims.

We claim:

1. An edge protector for protecting goods having at least one edge against damage of the edge by a strap wrapping the goods, the edge protector comprising:

a force-distributing member for distributing a force supplied by a wrapping strap to goods wrapped by the strap in such a manner as to protect the edge from damage by the strap; and a spring clip connected to the force-distributing member and engageable with the strap for securing the edge protector to the strap; wherein:

the clip comprises a proximal portion attached to the force-distributing member and a distal portion spaced apart from the proximal portion and adjacent to but detached from the force-distributing member;

the distal portion is formed with a cam that is contoured so that the strap can be pressed against the cam to elevate the distal portion of the clip relative to the force-distributing member and slid between the clip and the force-distrubuting member, the force-distributing member then extending underneath the strap and the clip overlying the strap, thereby securing the strap and the edge protector together and militating against their inadvertent separation even upon removal of the strap from the goods; and the cam intersects a rear surface that is contoured so that the strap if pressed against the rear surface will not elevate the distal portion of the clip, whereby the cam can be operated only in a latching direction.

2. An edge protector according to claim 1 wherein the force-distributing member is made of a material including a plastic.

3. An edge protector according to claim 1 wherein the force-distributing member is made of a material including a metal.

4. An edge protector according to claim 1 wherein the force-distributing member and the clip are made of the same material.

5. An edge protector according to claim 1 wherein the force-distributing member is substantially in the shape of a rectangle.

6. An edge protector according to claim 5 wherein the force-distributing member is formed with a score line facilitating its bending to form a dihedral angle, whereby the edge protector can be applied to the goods with the score line substantially overlying the edge and in parallel relation thereto.

7. An edge protector according to claim 6 wherein the dihedral angle is a right angle.

8. An edge protector according to claim 6 wherein the score line substantially bisects the rectangle, thereby dividing the edge protector into two legs of substantially equal size, the clip being connected to one of the legs.

9. An edge protector according to claim 8 wherein the clip is formed in a central portion of said one of the legs.

10. An edge protector according to claim 1 wherein the force-distributing member is formed with a through-slot and the clip is substantially coextensive with the through-slot.

11. An edge protector according to claim 10 wherein the cam includes an actuator portion that slopes toward the proximal portion and the force-distributing member, and the actuator portion includes an extension that normally penetrates into the through-slot.

12. An edge protector for protecting goods having at least one edge against damage of the edge by a strap wrapping the goods, the edge protector comprising:

a force-distributing member for distributing a force supplied by a wrapping strap to goods wrapped by the strap in such a manner as to protect the edge from damage by the strap; and a spring clip connected to the force-distributing member and engageable with the strap for securing the edge protector to the strap; wherein:

the clip comprises a proximal portion attached to the force-distributing member and a distal portion spaced apart from the proximal portion and adjacent to but detached from the force-distributing member;

the distal portion is formed with a cam that is contoured so that the strap can be pressed against the cam to elevate the distal portion of the clip relative to the force-distributing member and slid between the clip and the force-distributing member, the force-distributing member then extending underneath the strap and the clip overlying the strap, thereby securing the strap and the edge protector together and militating against their inadvertent separation even upon removal of the strap from the goods;

the force-distributing member is formed with a through-slot and the clip is substantially coextensive with the through-slot;

the cam includes an actuator portion that slopes toward the proximal portion and the force-distributing member, and the actuator portion includes an extension that normally penetrates into the through-slot; and the extension intersects a rear surface that is contoured so that the strap if pressed against the rear surface will not elevate the distal portion of the clip, whereby the cam can be operated only in a latching direction.

* * * * *